United States Patent [19]

Weinand

[11] 3,985,478

[45] Oct. 12, 1976

[54] ROTARY ENGINE ANTI-SPIN OIL SEAL

[75] Inventor: Louis H. Weinand, Troy, Mich.

[73] Assignee: General Motors Corporation, Detroit, Mich.

[22] Filed: Nov. 7, 1973

[21] Appl. No.: 413,545

[52] U.S. Cl. ..... 418/142; 277/137; 277/160

[51] Int. Cl.[2] ..... F01C 19/00

[58] Field of Search ..... 418/140, 142; 277/160, 277/136, 137, 158, 159

[56] References Cited

UNITED STATES PATENTS

| | | | |
|---|---|---|---|
| 1,847,731 | 3/1932 | Solenberger | 277/160 |
| 2,117,986 | 5/1938 | Robertson | 277/160 |
| 3,575,541 | 4/1971 | Hamada | 418/142 |
| 3,924,979 | 12/1975 | Rose | 418/142 |

*Primary Examiner*—C. J. Husar

*Attorney, Agent, or Firm*—Ronald L. Phillips

[57] ABSTRACT

A rotary engine anti-spin oil seal arrangement has a wave spring with tabs that project from each side and face in opposite angular directions so that one tab on one spring side catches in a hole in the bottom of the oil seal groove in the engine's rotor and a tab on the other spring side catches in a hole in the backside of the oil seal to prevent the oil seal from spinning in the oil seal groove while providing the same spring loading on the oil seal regardless of which may the wave spring is installed in the oil seal groove.

6 Claims, 11 Drawing Figures

ROTARY ENGINE ANTI-SPIN OIL SEAL

This invention relates to a rotary engine anti-spin oil seal arrangement and more particularly to such an arrangement wherein the oil seal spring acts to prevent oil seal spin on the rotor, and in addition, provides similar spring loading on the oil seal regardless of which way the spring is installed.

In the presently commercial rotary engine having a two-lobe internal peripheral wall and a three-lobe planetary rotor, a pair of circular oil seals are mounted in each side of the rotor and are biased by wave springs to sealingly engage stationary side walls. In addition sealing between each oil seal and the rotor is provided by an elastomeric O-ring which is mounted in an annular groove in either the inwardly or outwardly facing side of the oil seal and sealingly engages the oppositely facing side of the oil seal groove. It has been found that without some preventative provision the oil seals can spin in their grooves during engine operation with the undesirable result that there will occur relative rotation either between the oil seal and the O-ring or between the O-ring and the side of the groove that it engages. In either event, this spinning abrades the elastomeric O-ring and thus impairs its sealing effectiveness. Thus, it is desirable that the oil seals be prevented from spinning in their oil seal grooves. However, if the wave springs are to be utilized as a part of some anti-spin arrangement in an effort to reduce the cost of such provision, they should not have neither their spring action nor life substantially impaired nor should they provide different loading dependent upon which way they are installed if improper assembly is to be positively prevented.

An object of the present invention is to provide a new and improved rotary engine anti-spin oil seal arrangement.

Another object is to provide a rotary engine anti-spin oil seal arrangement having a simply modified wave spring that regardless of which way it is installed acts to prevent spinning of the oil seal in the oil seal groove and in addition provides the same spring load on the oil seal.

Another object is to provide a rotary engine oil seal arrangement having a wave spring with a pair of tabs that project from each side of the wave spring past the wave crests and have roots remote from the spring's contact areas and ends that face in opposite angular directions so that one of the tabs on one spring side catches in a hole in the bottom of the oil seal groove in the rotor and one of the tabs on the other spring side catches in a hole in the backside of the oil seal to prevent the oil seal from turning in the oil seal groove, and in addition, the same spring loading on the oil seal is provided regardless of which way the wave spring is installed in the oil seal groove.

These and other objects of the present invention will be more apparent from the following description and drawing in which.

Figure 1:
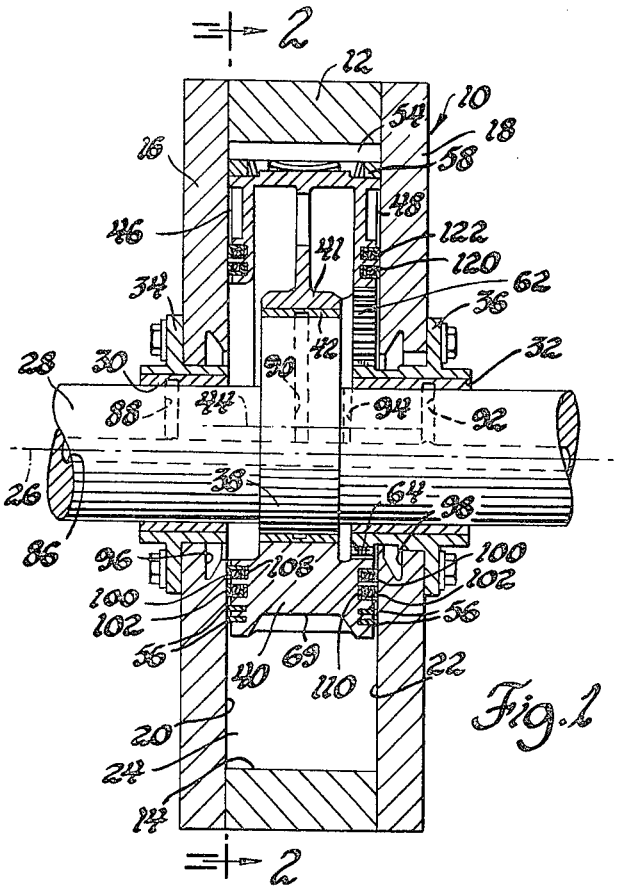
FIG. 1 is a longitudinal view with parts in section of a rotary engine having anti-spin oil seal arrangements constructed according to the present invention.
Figure 2:
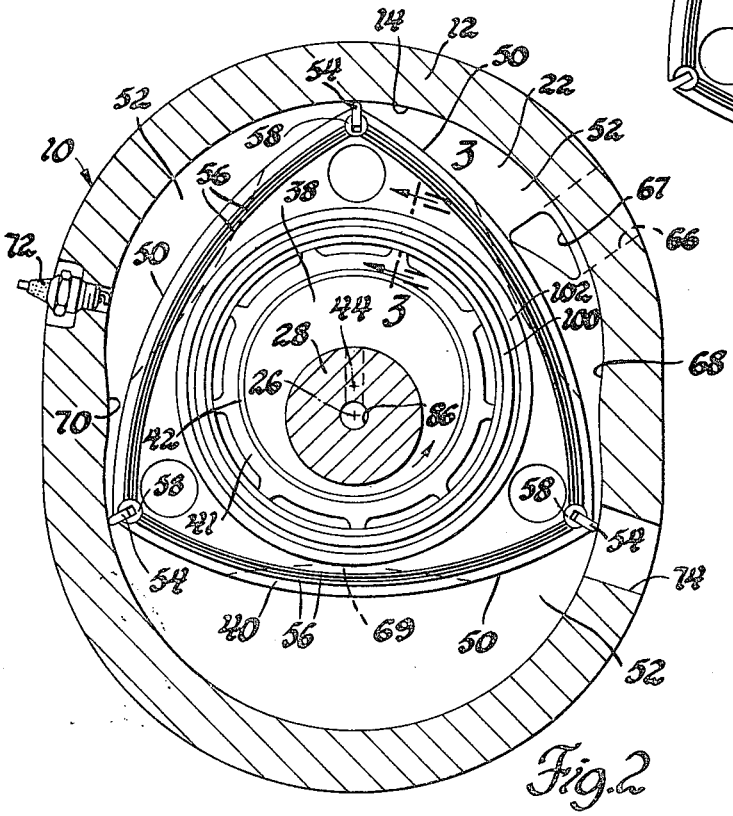
FIG. 2 is a view taken along the line 2—2 in FIG. 1 showing one rotor side.

The present invention is for use in a rotary combustion engine of the planetary type shown in FIGS. 1 and 2. The engine comprises a housing 10 which in a single rotor arrangement, as shown, has basically three parts; namely, a rotor housing 12 having an inwardly facing inner peripheral wall 14 and a pair of end housings 16 and 18 having parallel, oppositely facing, spaced inner end walls 20 and 22, respectively. The housing parts are secured together by bolts, not shown, and the inner housing walls 14, 20 and 22 cooperatively provide a cavity 24. As shown in FIG. 2, the peripheral wall is a two-lobe curve with a center line indicated at 26. A crankshaft 28 extends through the cavity and is rotatably supported in sleeve bearings 30 and 32 which are secured in collars 34 and 36 that are bolted to the end housings 16 and 18, as shown in FIG. 1, the crankshaft axis being coincident with the center line 26, parallel to the peripheral wall 14 and at right angles to the end walls 20 and 22. The crankshaft 28 is provided in cavity 24 with an eccentric 38. A three-lobe rotor 40 has a hub 41 having a sleeve bearing 42 secured therein which is received on the eccentric 38 so that the rotor is thereby supported in cavity 24 for rotation about the eccentric's center line 44 which is thus the rotor's axis.

The rotor 40 has the general shape of an arcuate sided triangle with two parallel side walls 46 and 48 at right angles to the rotor axis which face and run close to the end walls 20 and 22, respectively, and an outer peripheral wall having three arcuate outer faces 50 which face the peripheral wall 14 and cooperate therewith and with the end walls 20 and 22 to define three variable volume working chambers 52. Sealing of these chambers is effected by gas sealing means comprising three apex seals 54 which are each mounted in an axially extending groove or slot at each apex or corner of the rotor 40 and extend the width thereof. Six arcuate side seals 56 are mounted in pairs in accommodating grooves in each rotor side and extend adjacent the rotor faces between two of the apex seals 54. Three cylindrical corner seals 58 are mounted in cylindrical blind bores in each rotor side contiguous with the apex seal slots with each corner seal having a slot receiving one end of an apex seal and providing sealing between the ends of four side seals and one apex seal as shown in FIG. 2. The apex seals 54 are spring biased to engage the peripheral wall 14 and both the side seals 56 and the corner seals 58 are spring biased to engage the respective end walls 20 and 22 with the complete gas seal arrangement acting to seal the working chambers.

With the two-lobe peripheral wall 14 and the three-lobe rotor 40, each of the working chambers 52 sequentially expands and contracts between minimum and maximum volume twice during each revolution while the rotor apexes closely follow the peripheral wall by forcing the rotor to rotate at one-third the speed of the crankshaft. This is accomplished by gearing comprising an internal tooth gear 62 which is formed integral with the right-hand side 48 of the rotor with its center on the rotor axis. The gear 62 meshes with an external tooth annular gear 64 which is freely received about and is concentric with the crankshaft 28 and is made stationary by being formed integral with the left-hand end of the right-hand collar 36 as shown in FIG. 1. The gear 62 has one and one-half times the number of teeth as the gear 64 to provide the required speed ratio of 3:1 between the crankshaft and the rotor.

A combustible air-fuel mixture from a suitable carburetor arrangement, not shown, is made available to each working chamber 52 by an intake passage 66 as shown in FIG. 2. Intake passage 66 extends through the engine housing and opens to the cavity through either the peripheral wall 14 or through aligned end wall ports 67, only one of which is shown, or through a combination thereof with such porting being located on the leading side of cusp 68 of the peripheral wall relative to the direction of rotor rotation indicated by the arrow in FIG. 2. Thus, the rotor sides uncover the intake ports to the chambers as they are expanding in the intake phase to draw in the combustible mixture and then closes this passage to them when they are contracting to compress the mixture in the following compression phase. A single channel or recess 69 is provided in the center of each chamber face of the rotor so that when each rotor face is at or near its top-dead-center position with its center opposite the peripheral wall's other cusp 70, the associated chamber is not then divided by this cusp. A spark plug 72 is mounted in the rotor housing 12 adjacent the cusp 70 with its electrodes exposed to the passing working chambers and is supplied with voltage from a suitable ignition system, not shown, at the proper time at or near top-dead-center to initiate combustion at the end of the compression phase. On combustion the peripheral wall 14 takes the reaction forcing the rotor to continue rotating while the gas is expanding in the expansion or power phase. The leading apex seal 54 of each of the working chambers eventually traverses an exhaust passage 74 in the rotor housing on the trailing side of the cusp 68 whereby the exhaust products are then expelled in the exhaust phase to complete the cycle.

Figure 3:
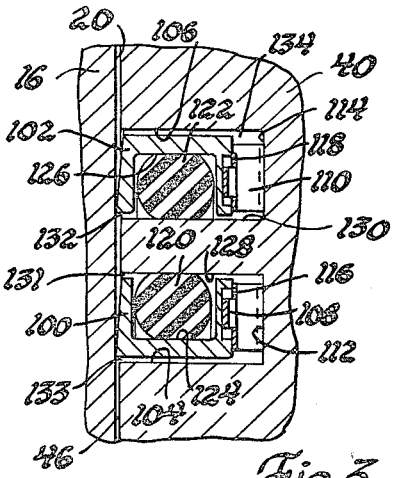
FIG. 3 is an enlarged view taken along the line 3—3 in FIG. 2.

Describing now the lubrication that is normally provided in such an arrangement and also cooling of the rotor, oil from the engine drains to a sump from which it is delivered by a suitable engine powered pump, not shown, to an axial oil passage 86 in the crankshaft 28 as shown in FIG. 1. Radial oil passages 88, 90 and 92 deliver oil from the passage 86 to lubricate the sleeve bearings 30, 42 and 32, respectively. The rotor 40 has a hollow interior and is webbed for rigidity and a radial oil passage 94 in the crankshaft 26 delivers oil from the passage 86 to lubricate the gears 62 and 64 and to the rotor's interior for cooling of the rotor with the oil carrying the heat from the rotor by passing to annular cavities 96 and 98 in the respective end walls 20 and 22 that are connected by passages, not shown, to drain to the sump. In addition to the gas seals carried on the rotor 40, there is provided in each side of the rotor inner and outer circular oil seals 100 and 102 of metal that are located radially inwardly of the side seals 56 in accommodating axially outwardly facing circular grooves 104 and 106 that are centered on the rotor axis 44. As best shown in FIG. 3, the oil seals 100 and 102 in each rotor side are biased to engage the oppositely facing housing end wall to prevent the oil supplied for lubrication and cooling from reaching the radially outwardly located gas seals by split annular wave springs 108 and 110 that engage on one spring side with the oil seal grooves' planar bottoms 112 and 114 and on the other spring side with the oil seals' planar backsides 116 and 118, respectively. In addition, sealing is provided between the oil seals 100 and 102 and the rotor by elastomeric O-rings 120 and 122 which are mounted in annular grooves 124 and 126 in the oil seals 100 and 102. The O-ring groove 124 in the inner oil seal 100 faces radially outwardly with the O-ring 120 engaging the oppositely facing side wall 128 of the oil seal groove 104. Conversely, the O-ring groove 126 in the outer oil seal 102 faces radially inwardly with the O-ring 122 engaging the oppositely facing side wall 130 of the oil seal groove 106. Thus, the O-rings 120 and 122 seal the respective clearances 131 and 132 between the oil seals 100 and 102 and the oil seal groove side walls 128 and 130 while the clearances 133 and 134 on the opposite sides of the oil seals are left open. Thus, in the case of the outer oil seal 102, gas pressure past the side seals 56 can pass through clearance 134 to act behind this oil seal to assist the spring bias while in the case of the inner oil seal 100, oil can pass through the clearance 133 to the chamber behind this oil seal where with centrifugal action there is developed hydraulic pressure to assist the spring bias on this oil seal.

Figure 4:
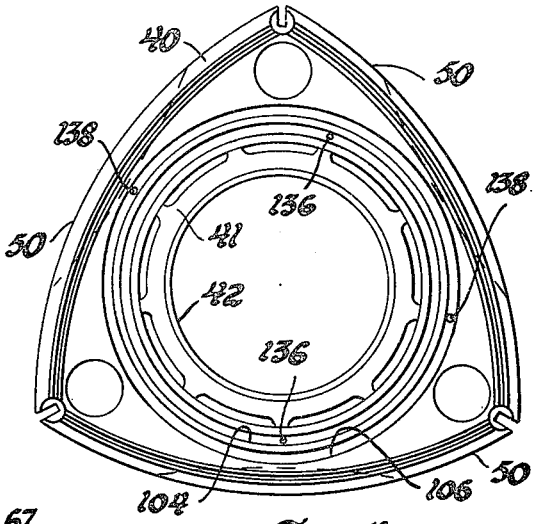
FIG. 4 is a view of the one rotor side in FIG. 2 but with the oil seals and wave springs removed.
Figure 5:
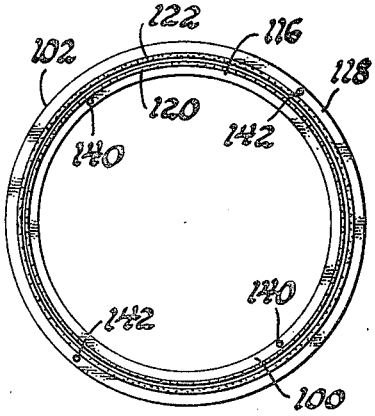
FIG. 5 is a view of the backside of the oil seals removed from FIG. 4.
Figure 7:
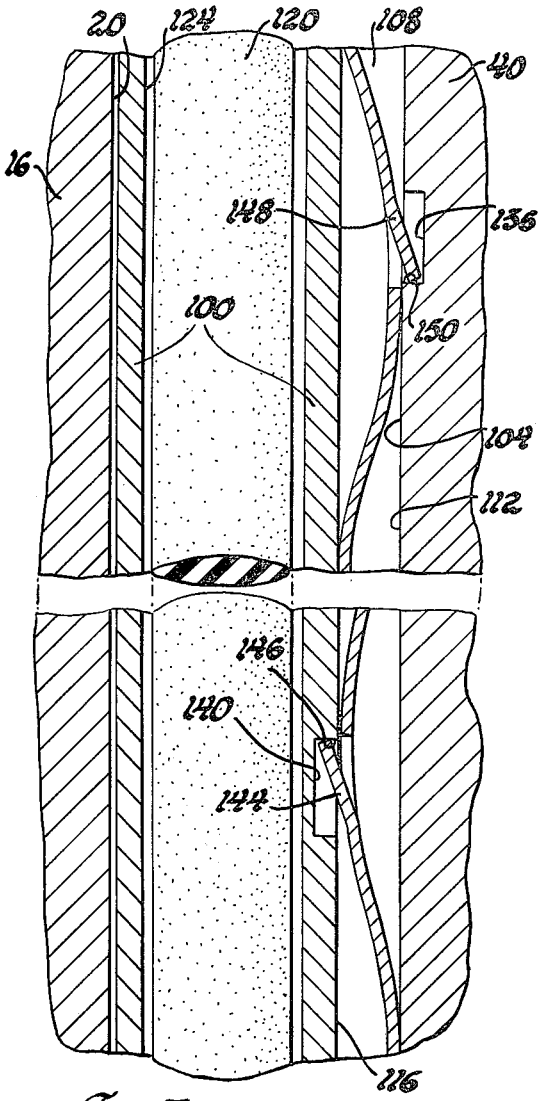
FIG. 7 is a view taken along the line 7—7 in FIG. 6.
Figure 8:
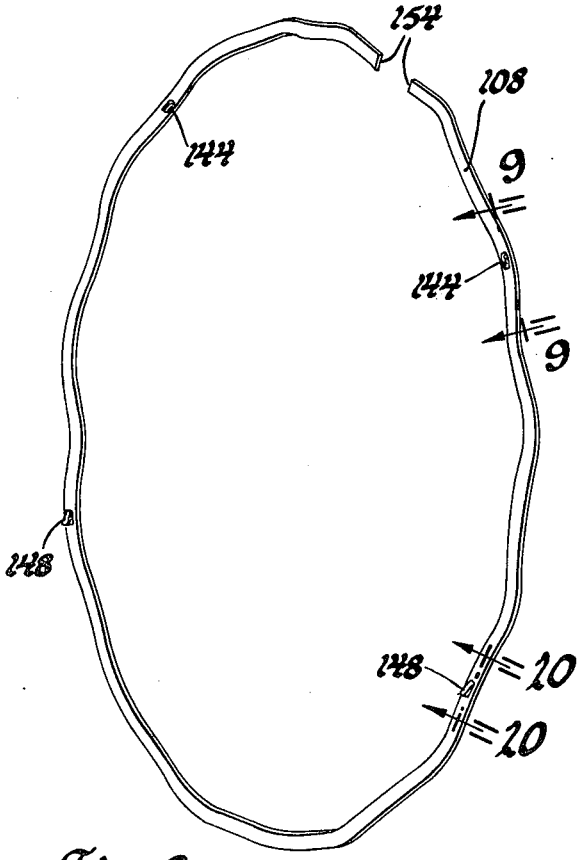
FIG. 8 is an enlarged perspective view of one of the wave springs.
Figure 9:
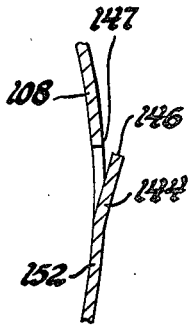
FIG. 9 is an enlarged view taken along the line 9—9 in FIG. 8.
Figure 10:
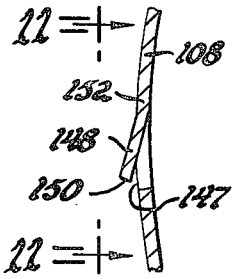
FIG. 10 is an enlarged view taken along the line 10—10 in FIG. 8.
Figure 11:
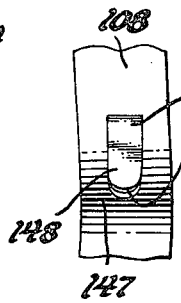
FIG. 11 is a view taken along the line 11—11 in FIG. 10.

The structure thus far described is conventional and without some anti-spin provision the oil seals can spin in their grooves causing impairment of the sealing effectiveness of the O-rings. Such adverse effect is positively prevented by the present invention with only very simple modifications to the wave springs, oil seal grooves and the oil seals. To prevent oil seal spin, a pair of shallow circular catch holes 136 and 138 are drilled in the planar bottoms 112 and 114 of the oil seal grooves 104 and 106 as shown in FIG. 4, are similarly, a pair of shallow circular catch holes 140 and 142 are drilled in the planar backsides 116 and 118 of the oil seals 100 and 102 as shown in FIG. 5. The catch holes 136 and 138 in the oil seal grooves are located over the rotor's ribs for structural integrity and as close to being diametrically opposite as possible while the catch holes 140 and 142 in the oil seals are arranged diametrically opposite each other and do not extend through to the annular O-ring grooves 124 and 126, the depth of the catch holes being clearly shown in FIG. 7. Each of the wave springs, such as the inner oil seal wave spring 108 shown in FIG. 8, is pierced at four substantially equally angularly spaced places to provide one pair of angularly spaced catch tabs 144 that project from one spring side and have ends 146 that are located at and project axially past the wave crests 147 on this spring side as shown in FIG. 10 and another pair of angularly spaced catch tabs 148 that project from the other spring side and have ends 150 that are located at and project axially past the wave crests on this spring side as shown in FIG. 9. The ends of all the catch tabs 144 and 148 are round with a radius less than the catch holes in the oil seal grooves and oil seals, as best shown in FIG. 11, and have roots 152 in the spring body located remote from the crests, as best shown in FIGS. 9, 10 and 11, so that the forming stresses produced in piercing the tabs are remote from the spring's contact areas with the result that the spring's strength and life is not substantially impaired by the tabs.

The pair of tabs 144 are located to either side of and are substantially equally angularly spaced from the ends 154 of the spring and project toward each other in opposite angular directions while the other pair of tabs 148 on the other spring side also project toward each other in opposite angular directions. With this arrangement the wave spring can be assembled in its oil seal groove with either side facing outward without changing the loading on the spring that results from the anti-spin connection it provides when on limited oil seal spin in its groove one of the catch tabs on one spring side catches in one of the oil seal groove catch holes and the catch tab on the other spring side that projects in the opposite angular direction from the caught catch tab is caught in one of the oil seal catch holes.

Figure 6:
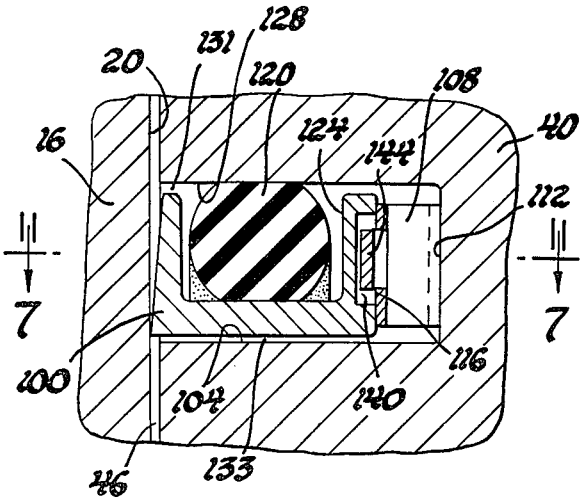
FIG. 6 is an enlarged sectional view through one of the anti-spin oil seal arrangements.

For example, when the inner oil seal's wave spring 108 is mounted in its oil seal groove 104 with the catch tabs 144 facing outward and the other catch tabs 148 facing inward as shown in FIG. 6, and on engine start-up and there occurs limited relative rotation or spin of the oil seal in its oil seal groove as indicated by the arrow, the end 146 of one of the catch tabs 144 is caught in the first catch hole 140 it encounters in the oil seal groove bottom and the end 150 of the catch tab 148 on the other spring side that faces in the opposite angular direction is caught in the first catch hole 136 it encounters in the oil seal backside whereby the oil seal is thereafter prevented from further spinning in the oil seal groove by the short length of the wave spring between these caught catch tabs providing a substantially rigid strut trapped in compression therebetween. If in the assembly the oil seal wants to spin in the opposite angular direction in the oil seal groove, the other tabs 144 and 148 on the opposite sides of the wave spring are then caught in the first catch holes they encounter to provide the same anti-spin action. Furthermore, if the wave spring is assembled opposite the way just described with the catch tabs 144 facing inward and the catch tabs 148 facing outward, one of the catch tabs 148 will then be caught in the first oil seal catch hole 140 it encounters and the catch tab 144 on the other side that projects in the opposite angular direction will be caught in the first oil seal groove catch hole 136 it encounters to provide the same anti-spin operation as aforementioned. In any event, the ends 154 of the wave spring are not active in the anti-spin operation nor does the spring provide a resilient anti-spin connection between the oil seal and rotor. Instead there is provided a short and thus substantially rigid strut that acts in compression to prevent oil seal spinning. Thus the spring loading on the oil seal is similar regardless of which way the wave spring sides face and there is no torquing up or torquing down of the wave spring dependent on which way the spring is installed that would affect the normal spring action. It will also be appreciated that the initial relative oil seal movement prior to the operation of the anti-spin arrangement is very limited and inversely proportional to the number of angularly spaced catch holes.

The above described embodiment is illustrative of the invention which may be modified within the scope of the appended claims.

I claim:

1. An oil sealing assembly for a rotary engine comprising: a wavy spring having a plurality of crests and valleys; a first burr projecting from a crest of said wavy spring generally upwardly with respect to said crest; an oil seal; a recess in said oil seal, said first burr being seated in said recess in said oil seal whereby relative movement between said wavy spring and said oil seal is eliminated when said wavy spring and said oil seal are positioned in a rotary engine; said wavy spring including a second burr positioned generally on a valley thereof and projecting downwardly with respect to said valley and with respect to said first burr for being received in a recess of a rotor into which said oil sealing assembly is to be inserted; said second burr comprising a hole punched in said wavy spring with portions of the material of said wavy spring projecting from the surface thereof around said hole to define said burr; said wavy spring having a gap in its circumference defining split ends, said first and second burrs located on a crest and a valley respectively which are spaced from said split ends by at least one intervening wave.

2. An oil sealing assembly for a rotary engine comprising: a wavy spring having a plurality of crests and valleys; a first burr projecting from a crest of said wavy spring generally upwardly with respect to said crest; an oil seal; a recess in said oil seal, said first burr being seated in said recess in said oil seal whereby relative movement between said wavy spring and said oil seal is eliminated when said wavy spring and said oil seai are positioned in a rotary engine; said wavy spring including a second burr positioned generally on a valley thereof and projecting downwardly with respect to said valley and with respect to said first burr for being received in a recess of a rotor into which said oil sealing assembly is to be inserted; said first and second burrs being positioned on adjacent crest and valley respectively.

3. A rotary engine having a housing with an inwardly facing peripheral wall and oppositely facing inner side walls cooperatively defining a cavity, a crankshaft rotatably supported in said housing, said crankshaft having an eccentric located in said cavity, a rotor rotatably mounted on said eccentric in said cavity, said rotor having sides facing said side walls and peripheral faces facing said peripheral wall defining a plurality of chambers that are spaced about and move with said rotor while varying in volume as said rotor rotates, a circular oil seal groove in each side of said rotor with its center on the rotor axis, a circular oil seal in each said oil seal groove axially movable to sealingly engage the opposing side wall, said oil seal having a planar backside, said oil seal groove having a planar bottom, a split circular wave spring mounted in said oil seal groove with crests on opposite sides engaging said groove bottom and said oil seal backside for biasing said oil seal to sealingly engage the opposite side wall, a circular catch hole in said oil seal groove bottom, a catch hole in said oil seal backside, one pair of catch tabs formed on said wave spring having ends projecting past the wave crests on one wave spring side, another pair of catch tabs formed on said wave spring having ends projecting past the wave crests on the other wave spring side, and the ends of each said pair of catch tabs facing in opposite angular directions so that regardless of which wave spring side engages said oil seal groove bottom and said oil seal backside and on limited rotation of said oil seal in either direction in said oil seal groove the end of one of the catch tabs projecting from one wave spring side is caught in said catch hole in said oil seal groove bottom and the end of the catch tab projecting from the other wave spring side facing in the opposite angular direction is caught in said catch hole in said oil seal backside whereby said oil seal is prevented from further rotation in said oil seal groove.

4. A rotary engine having a housing with an inwardly facing peripheral wall and oppositely facing inner side walls cooperatively defining a cavity, a crankshaft rotatably supported in said housing, said crankshaft having an eccentric located in said cavity, a rotor rotatably mounted on said eccentric in said cavity, said rotor having sides facing said side walls and peripheral faces facing said peripheral wall defining a plurality of chambers that are spaced about and move with said rotor while varying in volume as said rotor rotates, a circular oil seal groove in each side of said rotor with its center on the rotor axis, a circular oil seal in each said oil seal groove axially movable to sealingly engage the opposing side wall, said oil seal having a planar backside, said oil seal groove having a planar bottom, a split circular wave spring mounted in said oil seal groove with crests on opposite sides engaging said groove bottom and said oil seal backside for biasing said oil seal to sealingly engage the opposite side wall, a catch hole in said oil seal groove bottom, a catch hole in said oil seal backside, one pair of catch tabs formed on said wave spring having ends projecting past the wave crests on one wave spring side, another pair of catch tabs formed on said wave spring having ends projecting past the wave crests on the other wave spring side, all said catch tabs having roots remote from said crests, and the ends of each said pair of catch tabs facing in opposite angular directions so that regardless of which wave spring side engages said oil seal groove bottom and said oil seal backside and on limited rotation of said oil seal in either direction in said oil seal groove the end of one of the catch tabs projecting from one wave spring side is caught in said catch hole in said oil seal groove bottom and the end of the catch tab projecting from the other wave spring side facing in the opposite angular direction is caught in said catch hole in said oil seal backside whereby said oil seal is prevented from further rotation in said oil seal groove by the length of wave spring between the caught catch tabs providing a substantially rigid strut trapped in compression therebetween and the spring loading on said oil seal is similar regardless of which way the wave spring sides face.

5. A rotary engine having a housing with an inwardly facing peripheral wall and oppositely facing inner side walls cooperatively defining a cavity, a crankshaft rotatably supported in said housing, said crankshaft having an eccentric located in said cavity, a rotor rotatably mounted on said eccentric in said cavity, said rotor having sides facing said side walls and peripheral faces facing said peripheral wall defining a plurality of chambers that are spaced about and move with said rotor while varying in volume as said rotor rotates, a circular oil seal groove in each side of said rotor with its center on the rotor axis, a circular oil seal in each said oil seal groove axially movable to sealingly engage the opposing side wall, said oil seal having a planar backside, said oil seal groove having a planar bottom, a split circular wave spring mounted in said oil seal groove with crests on opposite sides engaging said groove bottom and said oil seal backside for biasing said oil seal to sealingly engage the opposite side wall, a circular catch hole in said oil seal groove bottom, a circular catch hole in said oil seal backside, one pair of angularly spaced catch tabs formed on said wave spring having rounded ends located at and projecting past the wave crests on one wave spring side, another pair of angularly spaced catch tabs formed on said wave spring having rounded ends located at and projecting past the wave crests on the other wave spring side, all said catch tabs having roots remote from said crests, and the ends of each said pair of catch tabs facing in opposite angular directions so that regardless of which wave spring side engages said oil seal groove bottom and said oil seal backside and on limited rotation of said oil seal in either direction in said oil seal groove the end of one of the catch tabs projecting from one wave spring side is caught in said catch hole in said oil seal groove bottom and the end of the catch tab projecting from the other wave spring side facing in the opposite angular direction is caught in said catch hole in said oil seal backside whereby said oil seal is prevented from further rotation in said oil seal groove by the length of wave spring between the caught catch tabs providing a substantially rigid strut trapped in compression therebetween and the spring loading on said oil seal is similar regardless of which way the wave spring sides face.

6. A rotary engine having a housing with an inwardly facing peripheral wall and oppositely facing inner side walls cooperatively defining a cavity, a crankshaft rotatably supported in said housing, said crankshaft having an eccentric located in said cavity, a rotor rotatably mounted on said eccentric in said cavity, said rotor having sides facing said side walls and peripheral faces facing said peripheral wall defining a plurality of chambers that are spaced about and move with said rotor while varying in volume as said rotor rotates, a circular oil seal groove in each side of said rotor with its center on the rotor axis, a circular oil seal in each said oil seal groove axially movable to sealingly engage the opposing side wall, said oil seal having a planar backside, said oil seal groove having a planar bottom, a split circular wave spring mounted in said oil seal groove with crests on opposite sides engaging said groove bottom and said oil seal backside for biasing said oil seal to sealingly engage the opposite side wall, a pair of angularly spaced circular catch holes in said oil seal groove bottom, a pair of angularly spaced circular catch holes in said oil seal backside, one pair of angularly spaced catch tabs formed on said wave spring having ends located at and projecting axially past the wave crests on one wave spring side, another pair of angularly spaced catch tabs formed on said wave spring having ends located at and projecting axially past the wave crests on the other wave spring side, all said catch tabs having roots remote from said crests, and the ends of each said pair of catch tabs being round with a radius less than said catch holes and facing in opposite angular directions so that regardless of which wave spring side engages said oil seal groove bottom and said oil seal backside and on limited rotation of said oil seal in either direction in said oil seal groove the end of one of the catch tabs projecting from one wave spring side is caught in the first catch hole it encounters in said oil seal groove bottom and the end of the catch tab projecting from the other wave spring side facing in the opposite angular direction is caught in the first catch hole it encounters in said oil seal backside whereby said oil seal is prevented from further rotation in said oil seal groove by the length of wave spring between the caught catch tabs providing a substantially rigid strut trapped in compression therebetween and the spring loading on said oil seal is similar regardless of which way the wave spring sides face.

* * * * *